US009436163B2

(12) United States Patent
Emmert et al.

(10) Patent No.: US 9,436,163 B2
(45) Date of Patent: Sep. 6, 2016

(54) LOCKING PINS FOR A WEARABLE DEVICE

(71) Applicant: Google Technology Holdings LLC, Mountain View, CA (US)

(72) Inventors: Steve C. Emmert, McHenry, IL (US); Paul L. Fordham, Wauconda, IL (US); Nicholas A. Fraser, Chicago, IL (US)

(73) Assignee: Google Technology Holdings LLC, Mountain View, CA (US)

( * ) Notice: Subject to any disclaimer, the term of this patent is extended or adjusted under 35 U.S.C. 154(b) by 0 days.

(21) Appl. No.: 14/444,324

(22) Filed: Jul. 28, 2014

(65) Prior Publication Data

US 2015/0370224 A1 Dec. 24, 2015

Related U.S. Application Data

(60) Provisional application No. 62/015,569, filed on Jun. 23, 2014.

(51) Int. Cl.

| | |
|---|---|
| ***G04G 17/08*** | (2006.01) |
| ***A44C 5/14*** | (2006.01) |
| ***G04B 37/14*** | (2006.01) |

(52) U.S. Cl.

CPC ..... *G04G 17/08* (2013.01); *A44C 5/14* (2013.01); *G04B 37/1486* (2013.01); *Y10T 29/49828* (2015.01)

(58) Field of Classification Search

CPC ..... G04G 17/00; G04G 17/08; G04B 37/11; G04B 37/113; G04B 37/116; G04B 37/0008; G04B 37/005; G04B 37/00; G04B 37/1486; A44C 5/14

USPC ..... 368/291–292, 309–313, 282; 224/164, 224/180; 220/253; 292/41, 86, 327

See application file for complete search history.

(56) References Cited

U.S. PATENT DOCUMENTS

| | | | | |
|---|---|---|---|---|
| 4,198,811 A * | 4/1980 | Ratajski | G04B 39/006 | 368/292 |
| 4,558,956 A * | 12/1985 | Bettschen | G04B 39/02 | 368/291 |
| 4,831,606 A * | 5/1989 | Aellen | G04B 37/1486 | 368/282 |
| 6,655,831 B1 * | 12/2003 | Ruffieux | G04B 37/116 | 368/281 |
| 6,779,917 B1 * | 8/2004 | Chappuis | G04B 37/0083 | 368/276 |
| 7,252,215 B1 * | 8/2007 | Furnas, II | A45C 1/04 | 224/164 |
| 7,277,360 B2 * | 10/2007 | Dufour | G04B 37/116 | 368/316 |

* cited by examiner

*Primary Examiner* — Justin Larson
*Assistant Examiner* — Scott McNurlen
(74) *Attorney, Agent, or Firm* — Faegre Baker Daniels LLP

(57) ABSTRACT

Disclosed are removable "locking pins" that hold the front and rear housings of a wearable device together. These pins fit into receiving channels in the walls of the housings. Unlike screws or other fasteners, these pins do not take up space needed for internal components of the device. Unlike snaps, the pins are usable with housings that are very rigid (e.g., metal or ceramic). In some embodiments, the pins are entirely hidden from view, and thus they do not detract from the appearance of the device. Also in some embodiments, the pins fit entirely outside of a water seal for the device, thus reducing cost and assembly complexity.

24 Claims, 9 Drawing Sheets

LOCKING PINS FOR A WEARABLE DEVICE

CROSS-REFERENCE TO RELATED APPLICATIONS

The present application claims priority to U.S. Provisional Patent Application 62/015,569, filed on Jun. 23, 2014, which is incorporated herein by reference in its entirety.

TECHNICAL FIELD

The present disclosure is related generally to wearable devices and, more particularly, to a housing for a wearable device.

BACKGROUND

"Sleekness" is a desired feature in wearable devices. For example, and for some people, thin wristwatches are more fashionable than thicker wristwatches. In another trend, wearable devices are supporting more and more features. A "smart" watch may include a messaging interface, an appointment calendar, and other features in addition to providing the current date and time.

Reconciling these two trends can be difficult: Devices tend to get thicker to support more features, but that makes them appear less "sleek." Alternately, a sleek profile may not contain enough volume to support the new features that users are beginning to expect.

BRIEF DESCRIPTION OF THE SEVERAL VIEWS OF THE DRAWINGS

While the appended claims set forth the features of the present techniques with particularity, these techniques, together with their objects and advantages, may be best understood from the following detailed description taken in conjunction with the accompanying drawings of which:

DETAILED DESCRIPTION

Figure 1:
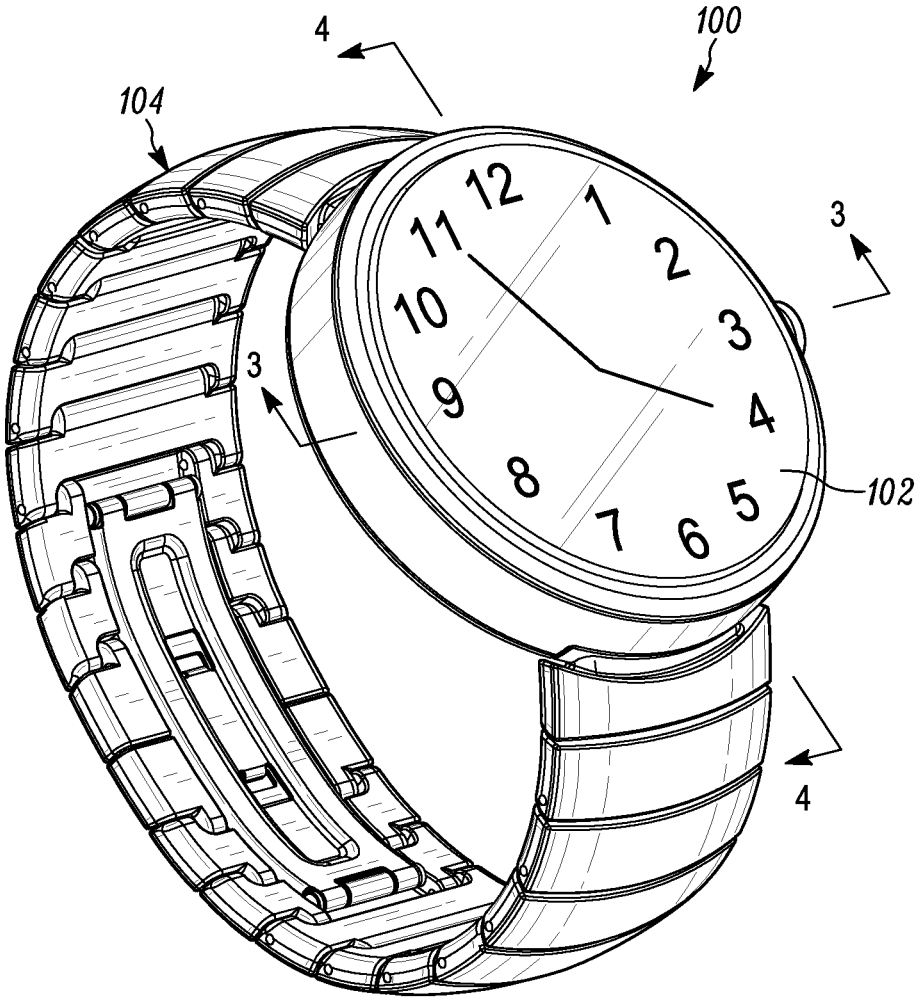
FIG. 1 is an overview of a representative smartwatch in which the present techniques may be practiced.

Turning to the drawings, wherein like reference numerals refer to like elements, techniques of the present disclosure are illustrated as being implemented in a suitable environment. The following description is based on embodiments of the claims and should not be taken as limiting the claims with regard to alternative embodiments that are not explicitly described herein.

The present disclosure describes removable "locking pins" that hold the front and rear housings of a wearable device together. These pins fit into receiving channels in the walls of the housings. Unlike screws or other fasteners, these pins do not take up space needed for internal components of the device. Unlike snaps, the pins are usable with housings that are very rigid (e.g., metal or ceramic). In some embodiments, the pins are entirely hidden from view, and thus they do not detract from the appearance of the device. Also in some embodiments, the pins fit entirely outside of a water seal for the device, thus reducing cost and assembly complexity.

FIG. 1 is an overview of a representative smartwatch 100 in which the present techniques may be practiced. The smartwatch 100 includes a display 102 and a wristband 104. While the present disclosure uses the form factor of the smartwatch 100 to illustrate the present techniques, it should be appreciated, however, that the techniques described herein may be implemented by any device 100 with a display 102, such as wearable devices (e.g., a smart bracelet, a smart ring, or smart glasses), a mobile phone, a notebook computer (e.g., netbook or ultrabook), a camera, a tablet computer, a personal media player, a personal navigating device (e.g., global positioning system), a gaming console, a desktop computer, a video camera, or a portable gaming device.

In the exemplary smartwatch 100 of FIG. 1, the display 102 is circular and can display information such as the current time, notifications, images, and the like. In some embodiments, the display 102 shows an analog watchface that tells the current time using one or more rotating pointers or hands that point to numbers arranged on a stationary dial. In other embodiments, the watchface uses rotating hour and minute dials and a stationary viewfinder that highlights the current time on the rotating dials. In some embodiments, the display 102 also hosts a user interface via which the smartwatch 100 can be configured and controlled. Note that in other embodiments, the display 102 may be of another shape, such as square, rectangular, triangular, and the like.

The wristband 104 holds the smartwatch 100 on the user's wrist. The wristband 104 may be of leather, metal, or another suitable material and may include a clasp to secure it. In some embodiments that use a metal wristband 104, an insulating piece (e.g., a plastic link) separates the metal wristband 104 from the front housing 200 (see FIG. 2) to prevent grounding of the antenna.

Figure 2:
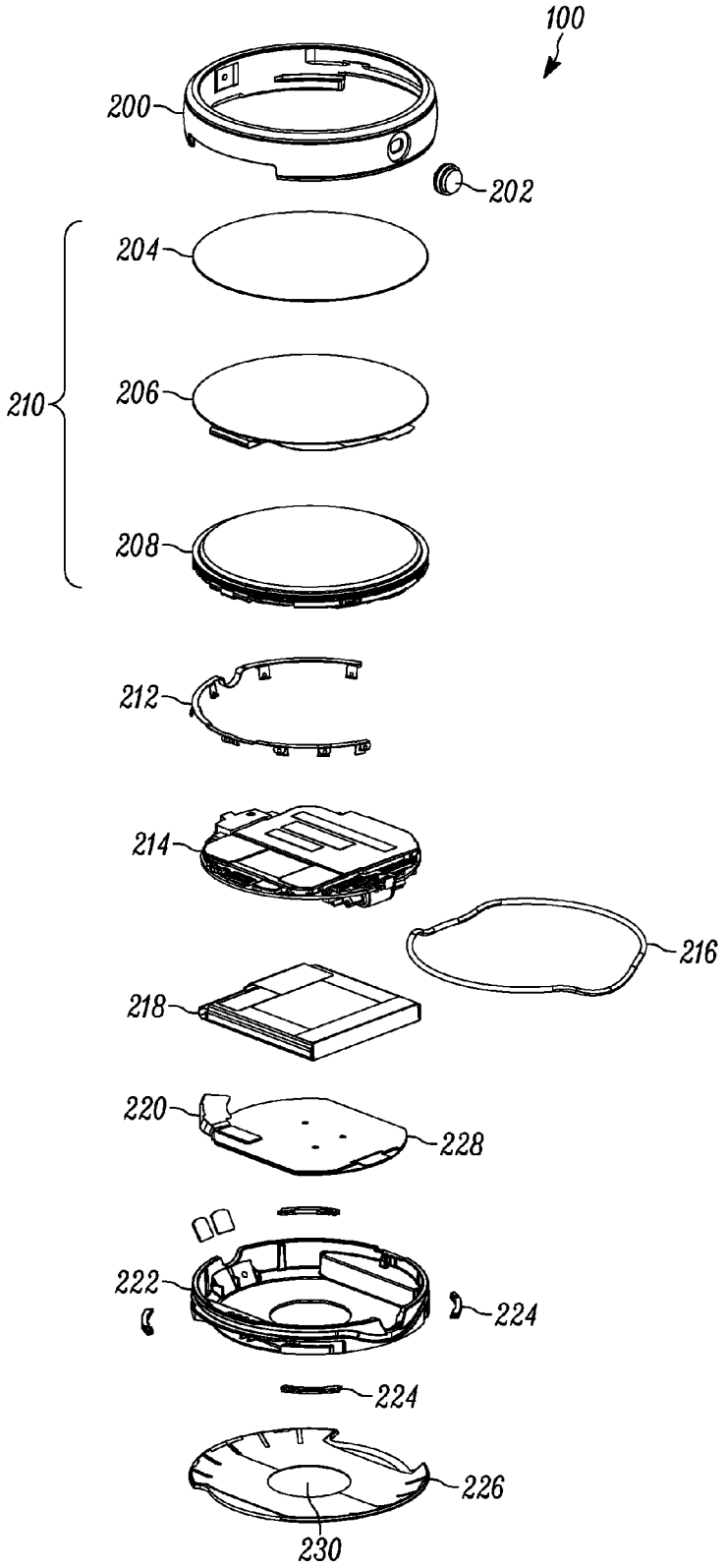
FIG. 2 is an exploded view showing the major components of the exemplary smartwatch of FIG. 1.

In FIG. 2, the smartwatch 100 of FIG. 1 is "exploded" to show its major components. In some embodiments, the smartwatch 100 incorporates these components in a "stack" as suggested by FIG. 2. In other embodiments, however, some of these components may be placed in other locations, major components may be combined into a unitary component, and some embodiments add other components not show in FIG. 2 to accomplish specific tasks.

Starting at the top of the component stack of FIG. 2, a front housing 200 provides a cavity that surrounds most of the other components. This front housing 200 may be made of any suitable material. In some embodiments, the front housing 200 is merely cosmetic, and the smartwatch's structural integrity is provided by other components. In some embodiments, the front housing 200 is metal and forms (along with the grounding ring 212 and the printed-circuit board 214 described below) an antenna (not separately shown in FIG. 2). The function of the antenna is described below with reference to FIG. 5.

In some embodiments, a power button 202 is supported by the front housing 200 and is used to turn the smartwatch 100 on and off.

The next three major components (the lens 204, the touch-sensor 206, and the display 208) are discussed together as the "lens assembly" 210. The lens 204 itself is generally formed of glass or sapphire. It is transparent and protects the components below it. Next in the lens assembly 210 is the (at least partially transparent) touch-sensor 206, such as a capacitive touch sensor. When so equipped, the lens assembly 210 becomes a touch-screen interface, whereby a user can touch the lens 204 and control the operation of the smartwatch 100. (In some embodiments, infrared or other sensors, not shown in FIG. 2, provide additional user-interface functionality.) Finally, the display 208 presents visual information to the user. The display 208 may be a liquid-crystal display, may use other flat-panel display technologies, or may be curved (e.g., using a plastic organic light-emitting diode or e-ink). While the lens 204, touch sensor 206, and display 208 are the major components of the lens assembly 210, in some embodiments, other layers can be included. For example, in one embodiment, the lens assembly 210 actually includes a glass lens 204 at the top, then a layer of optically clear adhesive, then a polycarbonate lens with some artwork (e.g., a trademark, decoration, or alignment marks used during manufacture of the lens assembly 210), then another layer of adhesive, then a clear polycarbonate lens, then the touch sensor 206, then the display 208, and then a supporting bezel. These other components are well known in the art.

During operation, the lens assembly 210 includes an active area and a border region. The active area includes pixels that are used to display content to the user. The border region provides structure for the lens assembly 210. In some embodiments, the width of the border region is less than 5% of the total diameter of the lens assembly 210. For example, the total diameter of the lens assembly 210 may range from 40 to 50 millimeters, while the border region is only 1 to 2 millimeters wide.

Next in the component stack is the grounding ring 212. In embodiments that include a slot antenna, the grounding ring 212 both drives and tunes the antenna.

The grounding ring 212 is attached to the printed-circuit board 214. As is typical with consumer electronic devices, the printed-circuit board 214 provides most of the "intelligent" functionality of the device 100. Because the printed-circuit board 214 with its associated components is so complicated, it is described with reference to its own FIG. 5, discussed below.

Continuing with the component stack of FIG. 2, the water seal 216 is an elastomeric ring. When the smartwatch 100 is fully assembled, the water seal 216 presses against other components to keep out water.

The electronics of the smartwatch 100 are powered by the battery 218. Generally, the shape of the battery 218 is determined by packaging constraints, the goal being to get the most capable battery 218 in the space allotted. Some embodiments include additional power sources, such as a pendulum that charges the battery 218 when the user moves the smartwatch 100. Such a pendulum may share some structural elements with a rotating vibrator 300 (see FIG. 3) used to provide haptic information to the user, e.g., as in the well known silent ring used in cell phones.

When placed in a charging system (not shown), the charging coil 220 receives electromagnetic energy and recharges the battery 218.

The rear housing 222 may be made of any suitable material, with ceramic preferred in some embodiments. Generally, the wristband 104 (see FIG. 1) attaches to the rear housing 222 with wristband-attachment pins (not shown) or via another well known mechanism. The housing-attachment locking pins 224 illustrated are one possible mechanism for connecting the rear housing 222 to the front housing 200. Embodiments of these locking pins 224 are described in greater detail below with reference to FIGS. 6 through 12. In some embodiments, a separate endplate 226 covers the rear housing 222.

In some embodiments, the smartwatch 100 includes one or more sensors on its rear face (the face touching the user's wrist). The example of FIG. 2 shows a "PPG" (PhotoPlethysmoGraphic) sensor 228 for reading the user's pulse rate. The PPG lens 230 allows the PPG sensor 228 to "look" through the rear housing 222 and the endplate 226. Other sensors are well known in the art and may be used here as well.

Figure 3:
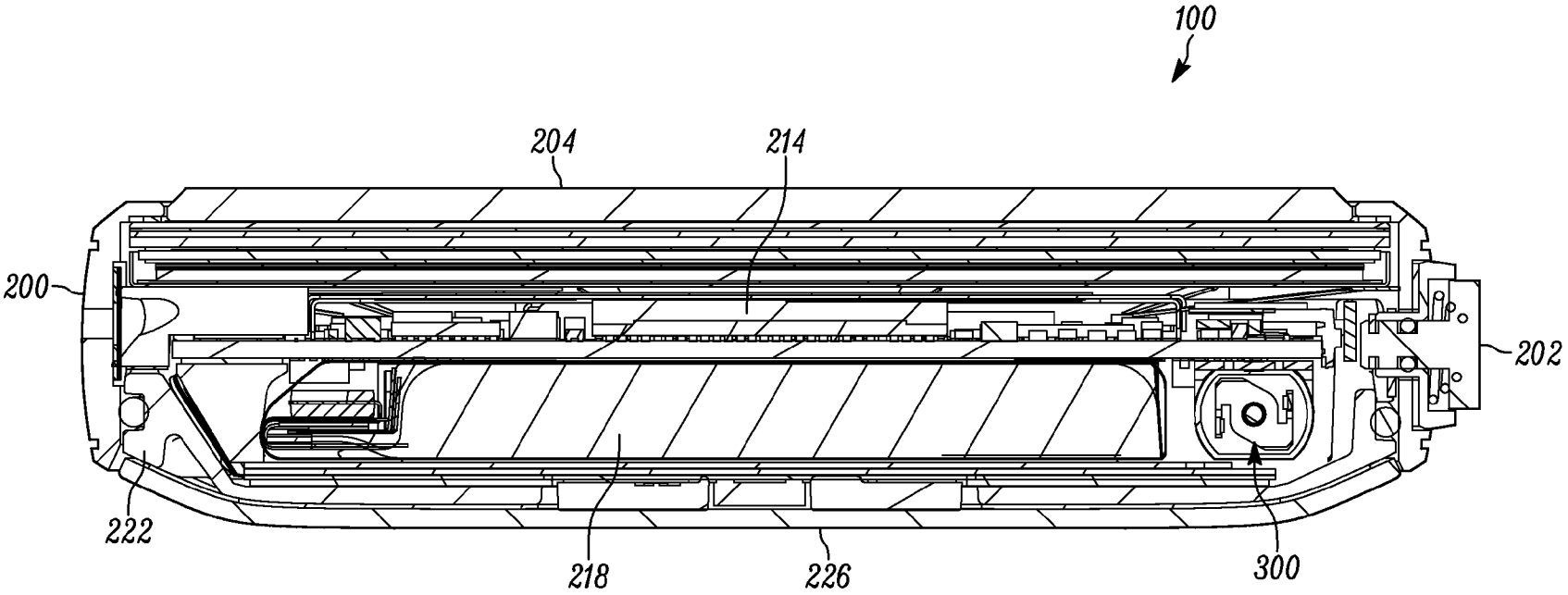
FIGS. 3 and 4 are cross-sectional views through the smartwatch of FIG. 1.
Figure 4:
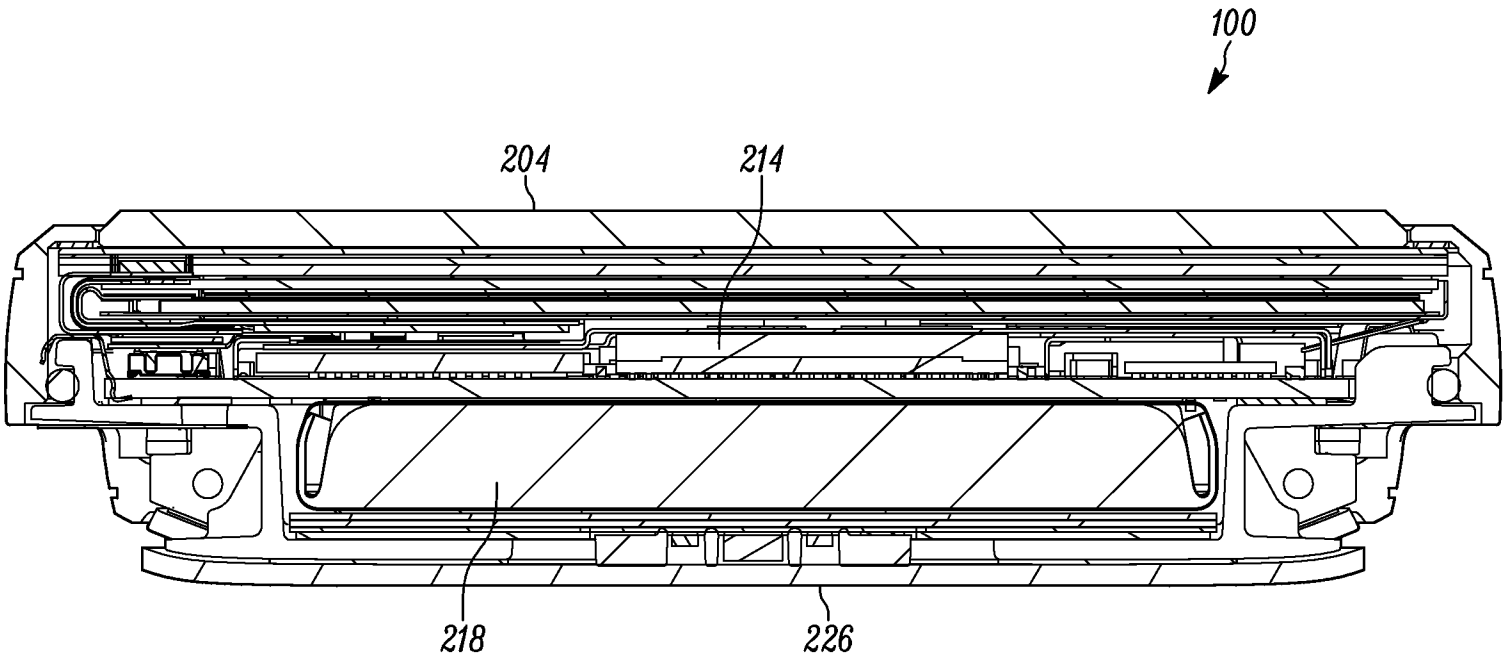

FIGS. 3 and 4 are cross-sectional views of the smartwatch 100 of FIG. 1. They show how the components of the exemplary stack of FIG. 2 fit together in some embodiments. For clarity's sake, only a few of the components of FIG. 2 are called out in FIGS. 3 and 4.

Figure 5:
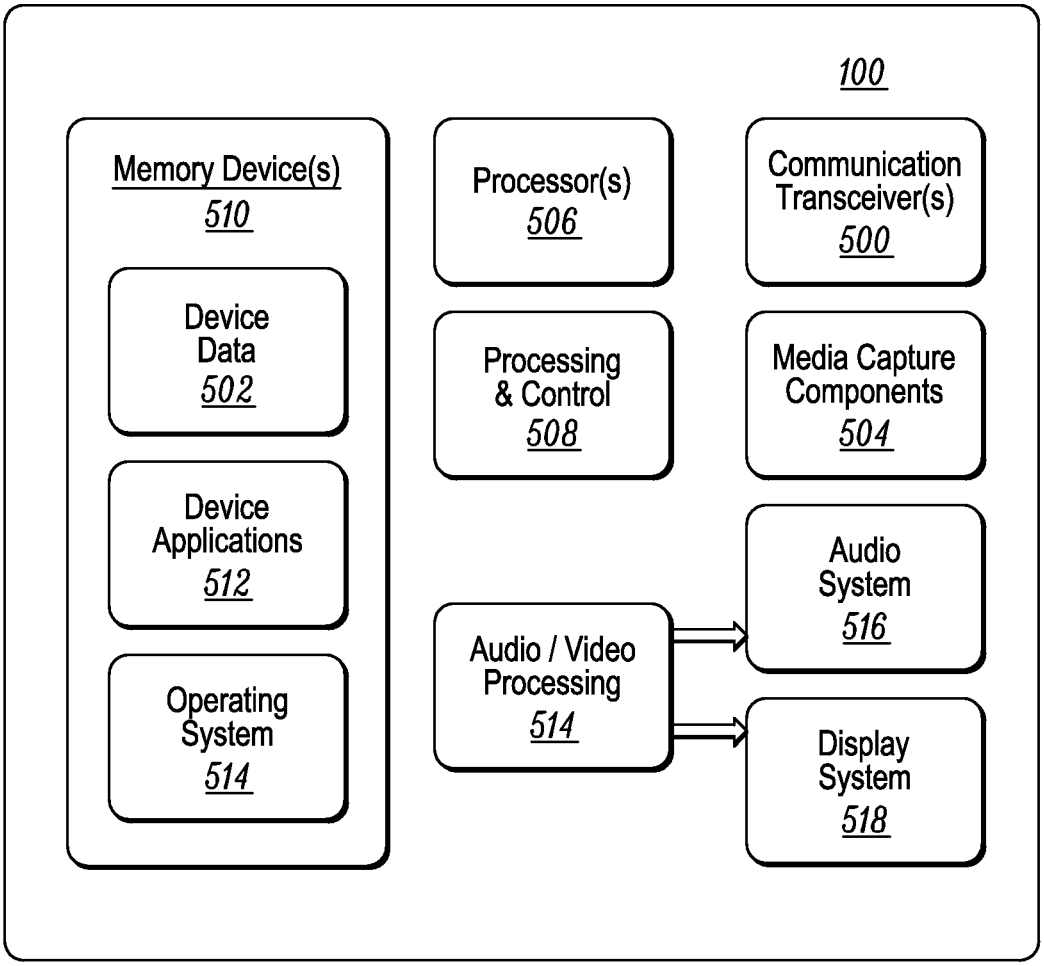
FIG. 5 is a simplified schematic of various electronic components of an exemplary smartwatch that can implement the present techniques.

FIG. 5 illustrates the various electronic components that provide much of the intelligence of the smartwatch 100. In some embodiments, these components, or many of them, reside on the printed-circuit board 214 of FIG. 2, though in some embodiments, some of these components may be located elsewhere.

The smartwatch 100 includes communication transceivers 500 that enable wireless transmission and reception of device data 502. Transceivers 500 can include radios compliant with various wireless personal-area-network standards, such as Institute of Electrical and Electronics Engineers ("IEEE") 802.15 standards, Infrared Data Association standards, or wireless Universal Serial Bus standards, to name just a few. Transceivers 500 can also include wireless local-area-network radios compliant with any of the various IEEE 802.11 standards, wireless-wide-area-network radios for cellular telephony, and wireless-metropolitan-area-network radios compliant with various IEEE 802.15 standards. The transceivers connect to one or more antennas, such as, in some embodiments, a slot antenna formed from the front housing 200, the grounding ring 212, and the printed-circuit board 214 of FIG. 2.

Through these communications transceivers 500, the smartwatch 100 communicates with other computing devices associated with the smartwatch's user. For example, the user's smartphone may receive a text message over a wireless network. The text message is then transmitted to the smartwatch 100. Upon receipt of the text message, the smartwatch 100 generates a notification regarding the text message. The notification is shown to the user on the display 102.

The smartwatch 100 may also include media-capture components 504, such as an integrated microphone to capture audio and a camera to capture still images or video content.

In addition to the PPG sensor 228 described with reference to FIG. 2, the smartwatch 100 may include other sensors (not shown) that are configured to receive sensor data, such as sensor data corresponding to movement. The sensors can include an accelerometer configured to receive accelerometer data, a global positioning system ("GPS") sensor configured to receive GPS data, or any other type of sensor configured to sense movement.

The smartwatch 100 includes one or more processors 506 (e.g., any of microprocessors, controllers, and the like), which process computer-executable instructions to control operation of the smartwatch 100. The smartwatch 100 can be implemented with software, hardware, firmware, or fixed-logic circuitry that is implemented in connection with processing and control circuits 508. Although not shown, the smartwatch 100 includes a system bus or data transfer system that couples the various components within the smartwatch 100. A system bus can include any one or combination of different bus structures, such as a memory bus or memory controller, a peripheral bus, a universal serial bus, or a processor or local bus that utilizes any of a variety of bus architectures.

The smartwatch 100 also includes one or more memory devices 510 that enable data storage, examples of which include random-access memory and non-volatile memory (e.g., read-only memory, flash memory, etc.). The smartwatch 100 may also include a mass-storage media device. A memory device 510 provides data storage mechanisms to store the device data 502, other types of information or data, and various device applications 512 (e.g., software applications). For example, an operating system 514 can be maintained as software instructions within a memory device 510 and executed on the processors 506. The device applications 512 may also include a device manager, such as any form of a control application, software application, signal-processing and control module, code that is native to a particular device, a hardware abstraction layer for a particular device, and so on.

The smartwatch 100 may also include an audio and video processing system 514 that generates audio data for an audio system 516 and generates display data for a display system 518. The audio system 516 or the display system 518 may include any devices that process, display, or otherwise render audio, video, display, or image data. Display data and audio signals can be communicated to an audio component or to a display component via a radio-frequency link, S-video link, high-definition multimedia interface, composite video link, component video link, digital video interface, analog audio connection, or other similar communication link. The display system 518 may include the lens assembly 210 shown in FIG. 2.

Figure 6:
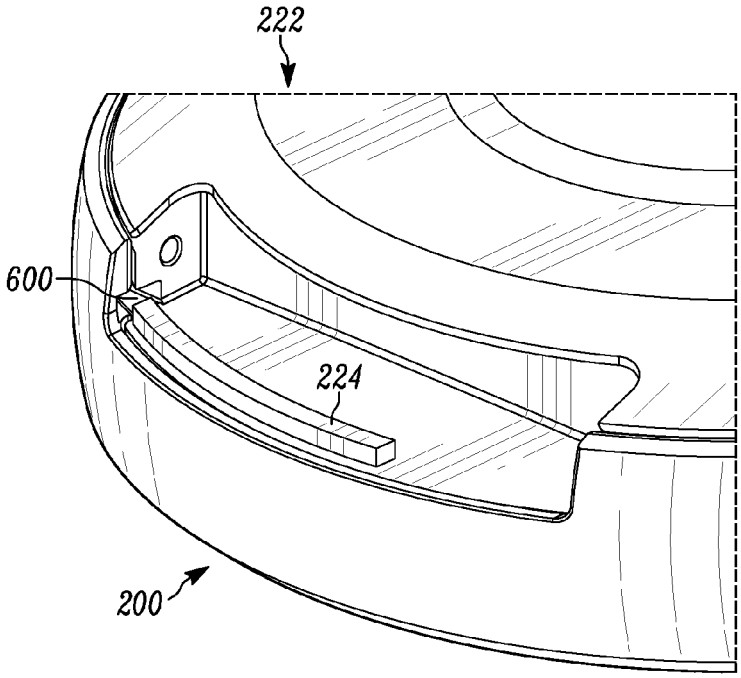
FIG. 6 is a rendering of a smartwatch showing the front and rear housings, a receiving channel, and a locking pin outside of the channel.

Embodiments of the locking pins are illustrated with respect to FIGS. 6 through 12. In FIG. 6, the rear 222 and front 200 housings are shown in their assembled position. When in this position, the housings 200, 222 define between them one or more receiving channels 600. (Only one is shown in FIG. 6.) A locking pin 224 is shown ready to be fit into the receiving channel 600.

Figure 7:
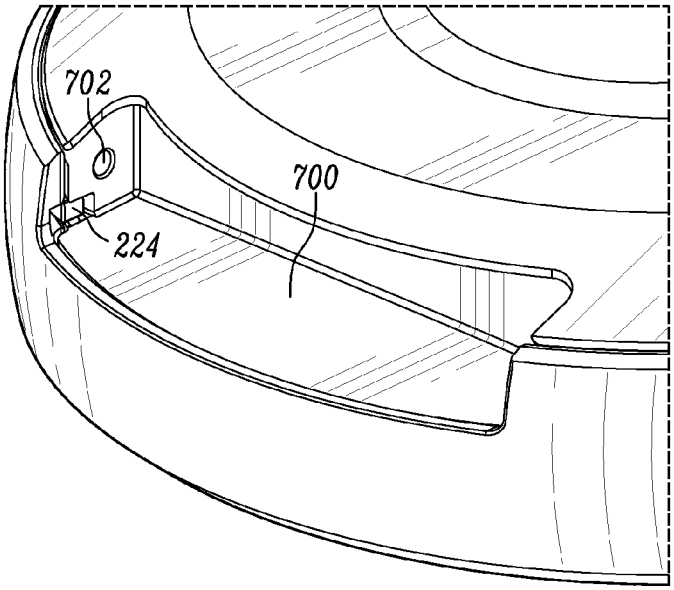
FIG. 7 is the same rendering as FIG. 6 but with the locking pin inserted into its receiving channel.

In FIG. 7, the locking pin 224 is fitted into the receiving channel. The cross-sectional view of FIG. 9 also shows the locking pin 224 in place. From FIG. 9, it is clear that the locking pin 224, when fitted into the receiving channel 600, prevents the front 200 and rear 222 housings from separating.

Figure 8:
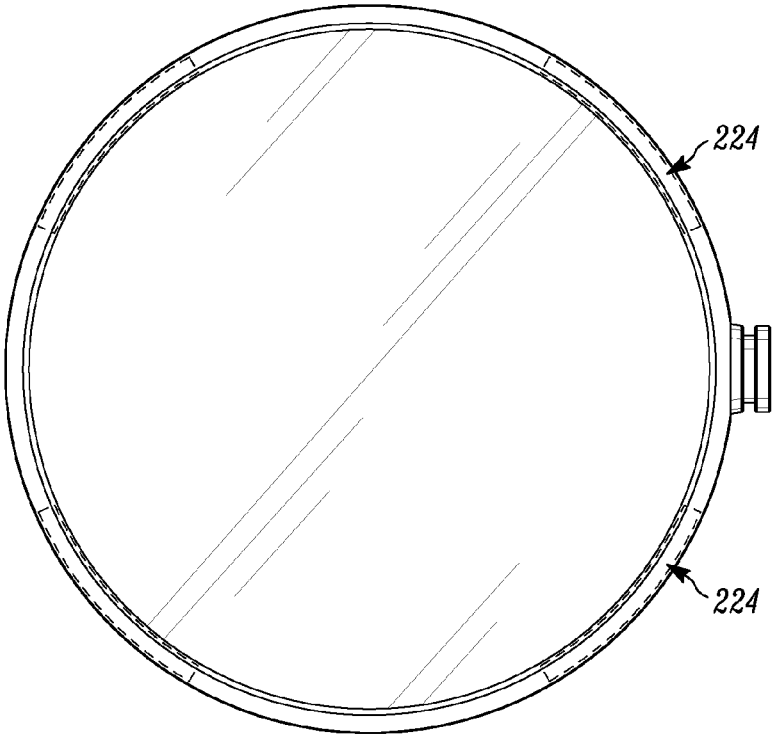
FIG. 8 is a rear view of a smartwatch showing the internal positions of four locking pins.

In some embodiments, multiple locking pins 224 are used with multiple receiving channels 600. FIG. 8 show four locking pins 224 in place. In some embodiments, the rear housing 222 includes two cutaway "pockets" 700 (FIG. 7), one on each side of the rear housing 222. Each pocket 700 receives an end of the wristband 104 (see FIG. 1), the wristband 104 possibly attached by pins that fit into holes 702 in the rear housing 222. In these embodiments, there can be an entrance to one receiving channel 600 on each side of each pocket 700, leading to the four locking pins 224 as shown in FIG. 8. These embodiments have the further advantages that the wristband 104, when in place, both hides the locking pins 224 and keeps them from backing out of the receiving channels 600.

Figure 9:
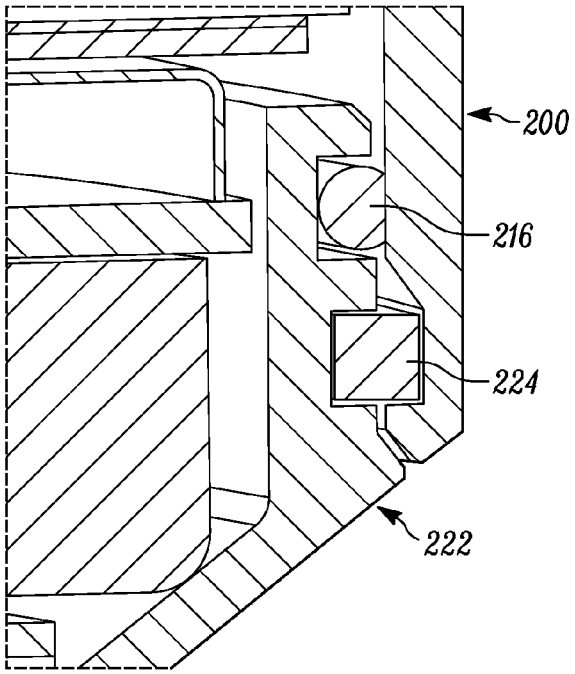
FIG. 9 is a cutaway of a smartwatch showing a locking pin in its receiving channel and a sealing ring above it.

FIG. 9 illustrates an advantage of some embodiments of the locking pin 224. As shown, the locking pin 224 is "outside of" the water seal 216. This positioning eases the assembly of the exemplary smartwatch 100.

FIGS. 6, 7, and 9 show the locking pin 224 and the receiving channel 600 each having a rectangular cross-section. This is not required, and other cross-sections are contemplated.

These figures also show the locking pin 224 and receiving channel 600 having arcuate shapes. While this shapes matches round embodiments of the exemplary smartwatch 100 very well, other shapes are possible, including straight and helical.

Figure 10:
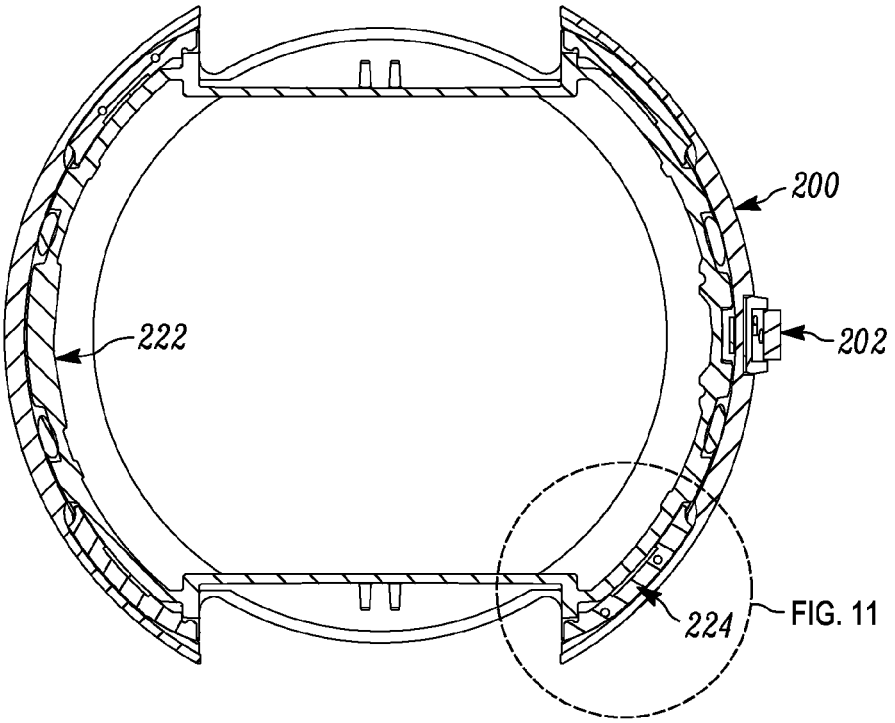
FIG. 10 is a cutaway of a smartwatch showing a position of a locking pin in its receiving channel.
Figure 11:
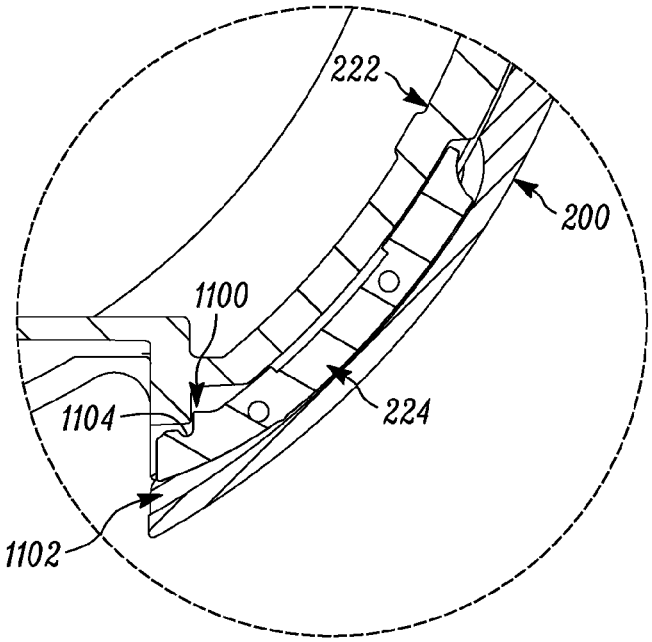
FIG. 11 is an expanded view of a portion of FIG. 10 showing another embodiment of a locking pin.

FIGS. 10 and 11 show another embodiment of the locking pin 224. FIG. 10 shows that these locking pins 224 are located in the same place as the locking pins 224 of FIG. 8. FIG. 11 shows how these locking pins 224 differ from those previously illustrated. Rather than being of uniform cross-section throughout, the locking pin 224 of FIG. 11 has a locking ledge 1100. When inserted into its receiving channel 600, the locking pin 224 flexes as the locking ledge 1100 is pushed back by a ridge on the rear housing 222. To allow for this flexure, the receiving channel 600 includes a flexure-clearance area 1102. When the locking pin 224 is pushed far enough in, the locking ledge 1100 moves past the ridge on the rear housing 222 and then snaps into place behind the ridge, taking up the position shown in FIG. 11. The ridge then keeps the locking ledge 1100, and consequently the entire locking pin 224, from backing out of the receiving channel. To remove the locking pin 224, it is flexed again (into the flexure-clearance area 1102) to allow the locking ledge 1100 to clear the ridge. The locking pin 224 is then pulled out. In some embodiments, the locking pin 224 includes a recess 1104 to facilitate this removal operation.

Figure 12:
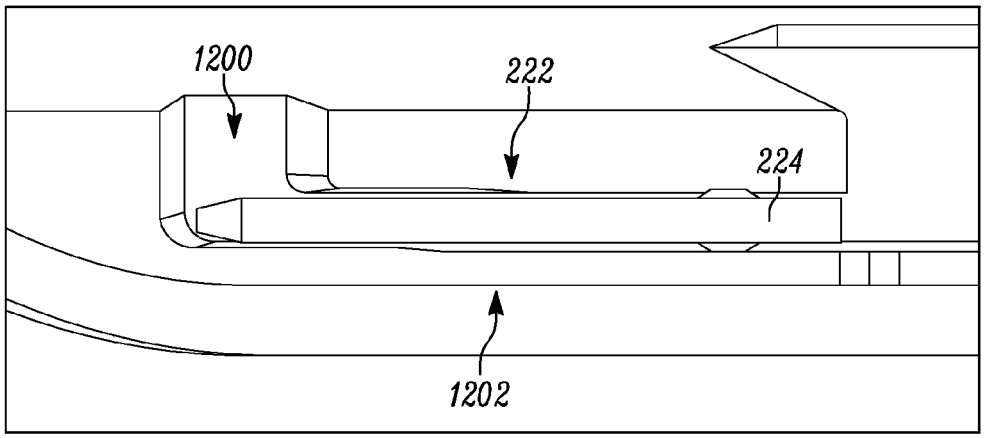
FIG. 12 is an expanded view of yet another embodiment of a locking pin in its receiving channel.

FIG. 12 shows a couple of options that can be used with the embodiments described above. In FIG. 12, the locking pin 224 is fully inserted into its receiving channel 600, thus locking the front 200 and rear housings 222 together. For clarity's sake, the front housing 200 is not shown in FIG. 12. The orientation of FIG. 12 is such that the user's wrist would be on the top of FIG. 12.

The first option illustrated in FIG. 12 is the "pick-out recess" 1200. This is an extension at the end of the receiving channel 600. A tool can be placed into the pick-out recess 1200 and used to lever out the locking pin 224 (by pushing it to the right of FIG. 12). In some embodiments, an endplate 226 (see FIG. 2 and accompanying text) attaches (e.g., using an adhesive) to the rear housing 222 and hides the pick-out recess 1200 from view. To disassemble the smartwatch 100, the endplate 226 is removed exposing the pick-out recess 1200. The locking pin 224 is then levered out, and the front 200 and rear housings 222 disengage.

The second option illustrated in FIG. 12 is the "Z-jog" 1202. This is a small variation in the overall horizontal path (from the viewpoint of FIG. 12) of the portion of the receiving channel 600 defined by the rear housing 222. The "Z" in "Z-jog" refers to the vertical direction of FIG. 12 (that is, the direction directly toward and directly away from the user's wrist and the display screen 102 of FIG. 1). The Z-jog 1202 provides for very tight control of the fit between the front 200 and rear housings 222 in the Z-axis.

Throughout the course of the receiving channel 600, the portion of the receiving channel 600 defined by the front housing 200 is nominally in line with the top of the locking pin 224 (see FIG. 9). Because of this, the front housing 200 (when the locking pin 224 is in place in its receiving channel 600) cannot move downward in the Z direction. This, in turn, ensures that the back of the lens assembly 210 cannot be shifted downward in the Z direction into the components on the printed circuit board 214. (See the order of these components in FIG. 2.)

Near the right end (as viewed in FIG. 12) of the receiving channel 600, the portion of the receiving channel 600 that is defined by the rear housing 222 is in line with the bottom of the locking pin 224. (This is toward the top in FIG. 12). This prevents the rear housing 222 from shifting upward in the Z direction relative to the front housing 200.

Near the left end (as viewed in FIG. 12) of the receiving channel 600, the portion of the receiving channel 600 that is defined by the rear housing 222 is in line with the top of the locking pin 224 (toward the bottom of FIG. 12). This prevents the rear housing 222 from shifting downward in the Z direction relative to the front housing 200.

Thus, the Z-jog in the receiving channel 600 prevents the front 200 and rear housings 222 from moving relative to one another in the Z direction.

Finally, in the middle of the receiving channel 600 as defined by the rear housing 222, there are tolerance gaps above and below the locking pin 224. These tolerance gaps, when combined with a slight flexure of the locking pin 224, allow for the tight combination of Z direction fit as described above while also allowing the locking pin 224 to be easily inserted and removed.

The locking pins 224 enable a straightforward method for assembling the exemplary smartwatch 100. Returning to FIG. 2, the internal components are loaded, in order from front to back, into the front housing 200. For example, the lens assembly 210 is placed in the front housing 200 from the rear side of the front housing 200. Then, the grounding ring 212 and the printed circuit board 214 are inserted (meanwhile making the necessary connections among the components). After the water seal 216, battery 218, PPG sensor 228, and any other internal components are put in place, the rear housing 222 is added, holding the internal components in their places. As described above, the front 200 and rear 222 housings are then connected together by inserting the locking pins 224 into the receiving channels 600. Optionally, the endplate 226 is then attached to the rear housing 222. Finally, the two ends of the wristband 104 are attached into the pockets 700, thus concealing the locking pins 224.

In view of the many possible embodiments to which the principles of the present discussion may be applied, it should be recognized that the embodiments described herein with respect to the drawing figures are meant to be illustrative only and should not be taken as limiting the scope of the claims. Therefore, the techniques as described herein contemplate all such embodiments as may come within the scope of the following claims and equivalents thereof.

We claim:

1. A wearable device comprising:

a front housing;

a rear housing removably attachable to the front housing; and a locking pin comprising a locking ledge;

wherein the front and rear housings when attached define a receiving channel comprising a flexure-clearance area;

wherein the locking pin is configured to fit into the receiving channel;

wherein the locking pin when in the receiving channel prevents the rear housing from detaching from the front housing;

wherein the rear housing comprises a ridge;

wherein the locking ledge and the ridge prevent the locking pin from backing out of the receiving channel when the front and rear housings are attached, and wherein the flexure-clearance area allows flexing of the locking pin to allow the locking ledge to clear the ridge to remove the locking pin.

2. The wearable device of claim 1 wherein the device is selected from the group consisting of: a health monitor, a wristwatch, and a smartwatch.

3. The wearable device of claim 1 wherein the rear housing comprises an element selected from the group consisting of: metal, ceramic, and plastic.

4. The wearable device of claim 1 wherein the receiving channel has a cross section selected from the group consisting of: circular and rectangular.

5. The wearable device of claim 1 wherein the receiving channel has a shape selected from the group consisting of: linear, arcuate, and helical.

6. The wearable device of claim 1 wherein the locking pin is configured to fit with a friction fit into the receiving channel.

7. The wearable device of claim 1 wherein the locking pin comprises a recess configured for use during removal of the locking pin.

8. The wearable device of claim 1 wherein the receiving channel comprises a pick-out recess.

9. The wearable device of claim 8:

wherein the device further comprises an endplate removably attached to the rear housing; and wherein when the endplate is attached to the rear housing, it hides an entrance to the pick-out recess from view.

10. The wearable device of claim 1 wherein the receiving channel further comprises a z-jog.

11. The wearable device of claim 1:

wherein the front and rear housings when attached form a plurality of receiving channels; and wherein the device comprises a plurality of locking pins, one locking pin for each of the plurality of receiving channels.

12. The wearable device of claim 1 wherein the locking pin is configured to slide into an entrance of the receiving channel.

13. The wearable device of claim 12 wherein the entrance of the receiving channel is formed in a pocket cut-out of the rear housing.

14. The wearable device of claim 13 wherein the pocket cut-out is configured to receive an end of a removably attachable wristband.

15. The wearable device of claim 14 further comprising: the removably attachable wristband.

16. The wearable device of claim 15 wherein when the removably attachable wristband is attached to the rear housing, the wristband hides the entrance of the receiving channel from view.

17. The wearable device of claim 15 wherein when the removably attachable wristband is attached to the rear housing, the wristband prevents the locking pin from exiting the receiving channel.

18. The wearable device of claim 1 further comprising a plurality of internal components held in place between the front and rear housings when the front and rear housings are attached.

19. A method of manufacturing a wearable device, the method comprising:

attaching a rear housing comprising a ridge to a front housing of the wearable device, wherein the front and rear housings when attached define a receiving channel comprising a flexure-clearance area;

fitting a locking pin comprising a locking ledge into the receiving channel, wherein the locking pin when in the receiving channel prevents the rear housing from detaching from the front housing;

wherein the locking ledge and the ridge prevent the locking pin from backing out of the receiving channel when the front and rear housings are attached, and wherein the flexure-clearance area allows flexing of the locking pin to allow the locking ledge to clear the ridge to remove the locking pin.

20. The method of manufacturing of claim 19 wherein fitting a locking pin comprising friction fitting the locking pin.

21. The method of manufacturing of claim 19:

wherein the front and rear housings when attached form a plurality of receiving channels;

the method further comprising fitting a plurality of locking pins into the plurality of receiving channels, one locking pin for each of the plurality of receiving channels.

22. The method of manufacturing of claim 19 wherein fitting a locking pin comprises sliding the locking pin into an entrance of the receiving channel.

23. The method of manufacturing of claim 22:

wherein the entrance of the receiving channel is formed in a pocket cut-out of the rear housing; and wherein the pocket cut-out is configured to receive an end of a removably attachable wristband;

the method further comprising attaching the end of the wristband to the rear housing.

24. The method of assembly of claim 19 further comprising:

loading a plurality of internal components between the front and rear housings before attaching the rear housing to the front housing.

* * * * *